United States Patent [19]

Ikuta Yoshiaki et al.

[11] Patent Number: 4,558,711

[45] Date of Patent: Dec. 17, 1985

[54] COIN PROCESSING APPARATUS

[75] Inventors: Ikuta Yoshiaki; Takashi Tanaka, both of Himeji, Japan

[73] Assignee: Glory Kogyo Kabushiki Kaisha, Hyogo, Japan

[21] Appl. No.: 626,827

[22] Filed: Jul. 2, 1984

[30] Foreign Application Priority Data

Jul. 8, 1983 [JP] Japan ..... 58-125326
Aug. 4, 1983 [JP] Japan ..... 58-142727

[51] Int. Cl.[4] ..... G07D 3/00
[52] U.S. Cl. ..... 133/3 F
[58] Field of Search ..... 133/3 F, 3 E; 194/100 A

[56] References Cited

U.S. PATENT DOCUMENTS 4,072,156 2/1978 Abe ..... 133/3 F
4,230,135 10/1980 Ueda ..... 133/3 F

*Primary Examiner*—Stanley H. Tollberg

*Attorney, Agent, or Firm*—Beveridge, DeGrandi & Weilacher

[57] ABSTRACT

In a coin processing apparatus, coins are inserted in a lump in a coin receiving unit, and are transferred through a conveyor section to a temporary retainer section, while the identifying unit identifies the coins when they are successively conveyed, and data concerning the coins identified are produced. After all the coins have been transferred out of the coin receiving unit, the coins are transferred from the temporary retainer section back to the coin receiving unit. When an accept command is inputted by an operator the coins having been transferred to the coin receiving unit are transferred again to the conveyor section, and the identifying unit identifies the coins as to denomination, and the separating devices selectively separate the coins from the conveyor path of the conveyor section in accordance with the result of the identification. The coins separated are led to containers respectively associated with the separating devices.

8 Claims, 12 Drawing Figures

COIN PROCESSING APPARATUS

BACKGROUND OF THE INVENTION

The present invention relates to a coin processing apparatus having a coin sorting function used as a coin pay-in and pay-out machine in a financial institution such as a bank.

In a financial institution such as a bank, machines capable of automatically (i.e., without need for an operator's manipulation) receiving bank notes, such as automatic depositing machines or automatic money receiving machines are more and more extensively used. But no machines having similar functions for coins have been available.

A machine having a slot for receiving coins one after another, like a presently available automatic vending machine may be considered but is not practical because it takes a long time where a large amount of coins have to be put in. It is desirable that a large amount of coins can be put in collectively or in a lump.

Also, it is often the case that this type of machine is manipulated not only by the staff of the financial institution but also by the customers. It is desirable that the inserted coins be returned if the person manipulating the machine does not confirm that the denominations of the coins and the amounts of the respective denominations of the coins as recognized by the machine coincide with those which the person himself recognized before putting the coins in.

Concerning coin dispensing, what were conventionally available were paying machines with a built-in coin dispenser provided therein and coin dispensing machine placed at the teller's window. With such a machine, it is necessary to always keep the dispensing unit filled with coins. It has been desired that a machine which is capable of receiving coins and using the received coins for the dispensing be realized.

It is also desired that such a machine is easy to manipulate since it is often used by customers, and is quick in processing the coins so as to reduce the waiting time, and is compact and lightweight.

No machine meeting such demands was available and it has been desiderated that such machines are realized.

SUMMARY OF THE INVENTION

An object of the invention is to provide a coin processing apparatus which is capable of accepting coins collectively or in a lump, of counting the coins of each denomination, of temporarily retaining the coins having been put in, and of taking the coins in after command from the person manipulating the apparatus, and which is therefore free from troubles such as erroneous recognition concerning the denominations and the amount, and is capable of reliable and high speed processing of the coins.

According to the invention there is provided a coin processing apparatus comprising:

coin receiving means for receiving coins in a lump;

conveyor means including a conveyor path, receiving the coins from the coin receiving means and conveying the coins successively;

identifying means for identifying each coin as to denomination as the coin is conveyed by the conveyor means;

temporary retainer means receiving the coins from the conveyor means and transferring the coins to the coin receiving means;

separating devices provided to separate, when actuated, the coin from the conveyor path;

container devices associated with the respective separating devices to receive and contain the coins separated by the associated separating device; and control means causing, when coins are inserted in the coin receiving means, the coin receiving means and the conveyor means to be actuated such that the coins be transferred from the coin receiving means, through the conveyor means to the temporary retainer means and causing the identifying means to identify the coins successively conveyed by the conveyor means, and to produce data concerning the coins identified, said control means causing, after all the coins inserted have been transferred out of the coin receiving means, the temporary retainer means to be actuated such that the coins be transferred from the temporary retainer means to the coin receiving means, the control means being responsive to an accept command inputted by an operator for actuating the coin receiving means and the conveyor means such that the coins having been transferred from the temporary retainer means to the coin receiving means be transferred to the conveyor means, and causing the identifying means to identify the coins as to denomination, and causing the separating devices to selectively separate the coins in accordance with the result of the identification.

BRIEF DESCRIPTION OF THE DRAWINGS

Features and advantages of the invention will be more apparent from the following description of the embodiments taken in conjunction with the accompanying drawings, in which.

DETAILED DESCRIPTION OF THE PREFERRED EMBODIMENTS

Figure 1:
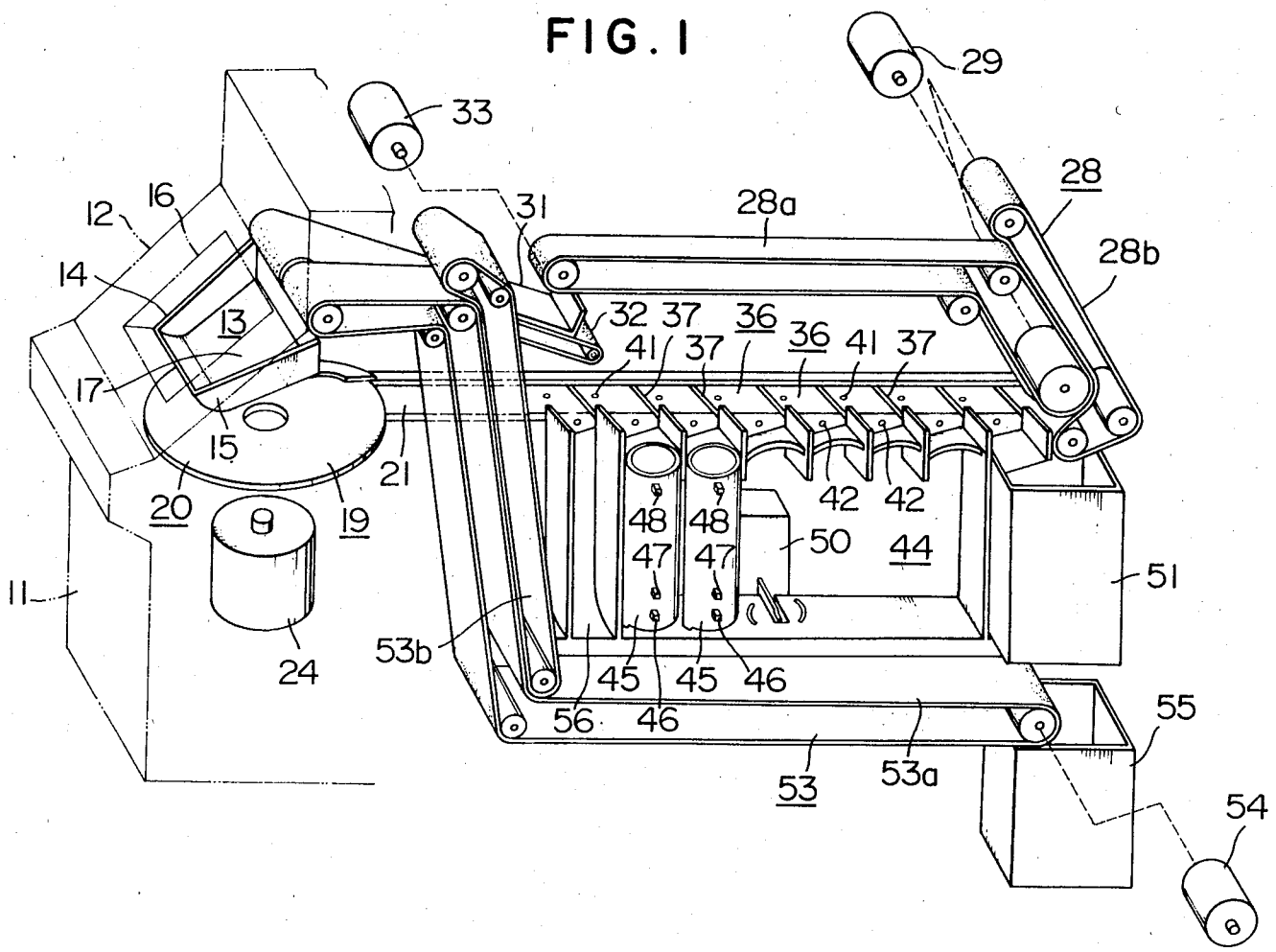
FIG. 1 is a schematic view showing an embodiment of the coin processing apparatus according to the invention.

Referring now more particularly to FIG. 1, denoted by reference numeral 11 and illustrated by chain lines is an outer casing of a coin processing apparatus embodying the invention. Provided on the inclined panel of the front side (the left side as viewed in FIG. 1) is a console unit including data input unit and a display unit. Thus the inclined panel forms a customer reception surface 12. Also provided in the inclined panel is an opening 14 forming part of a coin receiving unit 13. The coin receiving unit 13 also includes a hopper 15 provided in the casing 11 in alignment with the opening 14. The opening 14 is provided with a shutter (insertion shutter) 16 for opening and closing, and the hopper 15 is provided at its bottom with a shutter (a hopper shutter) 17.

Figure 2:
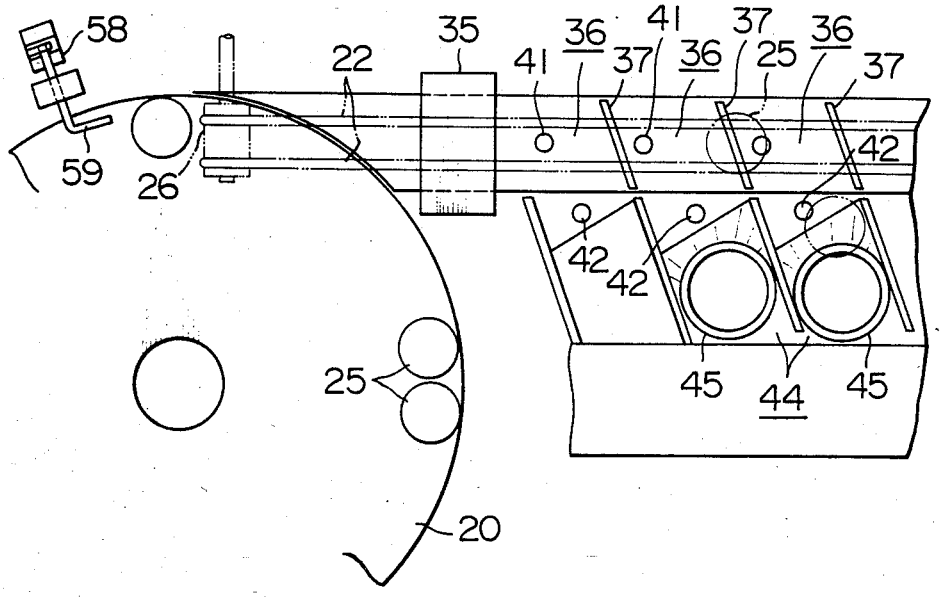
FIG. 2 is an enlarged plan view showing an example of separating sections.

Denoted generally by reference numeral 19 is a conveyor section which comprises a rotatable disk 20 positioned under the hopper 15 and a coin path 21 extending along a tangential line of the periphery of the disk 20. Provided over the path 21 are conveyor belts 22, as shown in FIG. 2, for conveying coins. The disk 20 is driven by a motor 24 to rotate, and causes the coins 25 supplied from the hopper 15 to be pressed against an inner peripheral wall by centrifugal force and feeds the coins one after another into the path 21. The conveyor belts 22 are endless belts extending along the path 21 and are driven by a motor 26. The conveyor belts 22 hold the coins 25 between the belts 22 and the upper surface of the path 21 and cause the coins to move along the length of the path 21.

Denoted by reference numeral 28 is an auxiliary conveyor section comprising a conveyor belt **28*a* which extends obliquely upward from the rear end (the right end as viewed in FIG. 1) and then bends and extends horizontally in parallel with the path 21 and terminates near the front end (the left end as viewed in FIG. 1) of the path 21. The auxiliary conveyor section 28 also comprises another conveyor belt 28*b* which extends from the rear end of the path 21, obliquely upward along the conveyor belt 28*a*. The belts 28*a* and 28*b* of the auxiliary conveying unit 28 is driven by a common motor 29. Coins which have been passed through the path 21 are held between the belts 28*a* and 28*b* and are conveyed by the belts 28*a* and 28*b* obliquely upward and then conveyed by the belt 28*a* frontward (leftward as viewed in FIG. 1**).

Denoted by reference numeral 31 is a temporary retainer which comprises a conveyor belt 32 having a bucket mounted thereon extending from under the end (left end as viewed in FIG. 1) of the conveyor belt **28*a* and terminates over the hopper 15 . (The side walls of the bucket are not shown.) The conveyor belt 32 is normally at a rest position to receive coins which are supplied from the conveyor belt 28*a*, and to temporarily retain the coins by means of the bucket. Upon fulfillment of a certain condition to be described later, the belt 32 is driven by a motor 33 to supply or transfer the coins onto the hopper 15**.

In FIG. 2, a coin identifying unit 35 is provided near the front end of the path 21 and identifies the denomination of each coin 25 passing through the path 21. The identification is accomplished by detecting the diameter and the material of each coin 25 by means of a magnetic head, an optical image sensor, or the like. More particularly, the identification is made by comparison of the signals from the magnetic head, the optical image sensor, and the like, or the combinations of such signals with those expected for the respective denominations. When it is found that the signals or the combinations of the signals do not accord to any of those expected (do not fall within any of the predetermined ranges) the coin in question will be regarded as an abnormal coin. Deformed coins and worn-out coins will also be regarded as abnormal coins.

Figure 3:
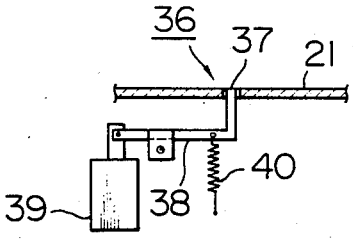
FIG. 3 is a sectional view showing one of the separating sections of FIG. 2.

Separating sections 36 are provided in sequence along the length of the path 21 as shown in FIG. 1 and FIG. 2. Separating sections are provided for the respective denominations and deflect the coins of the corresponding denominations to the side of the path 21 in accordance with the information concerning the denominations supplied from the identifying unit 35. For this purpose, each separating section 36 has a branching plate 37 extending slantwise with reference to the length of the path 21 to obstruct the passage of the coin to be deflected. As best illustrated in FIG. 3, each branching plate 37 is actuated by a solenoid 39 coupled by an arm 38 to project into the path 21 and is withdrawn from the path 21 by the tension exerted by a return spring (in the form of a tension spring) 40. Each separating section 36 is also provided with a first sensor 41 for detecting a coin 25 on the path 21 within the particular separating section 36 and a second sensor 42 positioned at the side of the path 21 to detect deviation of a coin from the path 21. The output of the first sensor 41 is used in conjunction with the information from the identifying unit 35 as a condition for energizing the solenoid 39. The output of the second sensor 42 is used as a condition for deenergizing the solenoid 39.

One of the separating sections 36, for instance, the leftmost (as viewed in the Figures) is used to deflect the coins regarded as abnormal coins by the identifying unit 35 to the side of the path 21. The second leftmost and the subsequent separating sections 36 are used to deflect the "normal" coins of respective denominations. For instance, the second separating section 36 is for 1-yen coins, the third separating section 36 is for 5-yen coins, and so on. The last (rightmost) separating section is for overflow coins, which will be described later.

A coin container section 44 comprises coin container cylinders 45 provided at the sides of the respective separating sections 35, except that for the abnormal coins, to receive and contain the coins in pile, i.e., with one upon another. Each coin container cylinder 45 is provided at its bottom with an emptiness sensor to determine whether or not there is any coin in the cylinder, and a near end senser 47 positioned a little above the emptiness sensor 46 and a fullness sensor 48 at the top of the cylinder. When a cylinder 45 is found to be full, the coins corresponding to the cylinder 45 are not deflected by the corresponding separating section 36 but are guided via the last separating section to an overflow coin container box 51 to be described later.

Coin discharging devices 50 are provided for the respective coin container cylinders 45 and discharge the coins of the respective container cylinders one by one. An example of coin discharging device 50 usable is one shown in Japanese Patent Application Laid-open (Kokai) No. 6985/1982 which comprises a cam and a lever actuated by rotation of a motor to push out the coin in the lowermost position in the pile. The overflow coin container box 51 is provided in association with the last separating section 36 to receive and contain the coins corresponding to the container cylinder or cylinders 45 having been found full.

A pay-out conveyor section 53 comprises a conveyor belt **53*a* which extends along the sides of the coin container cylinders 45 to receive coins discharged from the cylinders 45 and then obliquely upward, and then again horizontally terminating over the hopper 15, and another conveyor belt 53*b* provided along the upward extending portion of the conveyor belt 53*a*. These conveyor belts 53*a* and 53*b* are both driven by a common reversible motor 54. Coins discharged from the container cylinders 45** are conveyed by the conveyor belt 53*a* alone and then by the combination of the conveyor belts 53*a* and 53*b* being held between them and then by the conveyor belt 53*a* and are dropped into the hopper 15 to be served as pay-out coins. The pay-out conveyor section 53 also serves as a recovery conveyor section. That is, when the motor 54 is rotated in the reverse direction, the coins discharged from the container cylinders 45 are conveyed to the right (in FIG. 1) and are dropped into a recovery box 55 provided under the right end of the conveyor belt 53*a*.

A reject return section 56 comprises a chute provided at the side of the leftmost separating section 36 to guide the coins separated at the leftmost separating section 36 onto the conveyor belt 53*a*.

A coin senser 58 is provided to determine presence or absence of a coin on the disk 20. The sensor 58 comprises a stylus 59 projecting to the proximity of the coin push-out portion of the disk and movable or tiltable when pushed up by any coin on the disk 20, and means (not illustrated) such as a photo-coupler for detecting the movement of the stylus 59 due to push-up of the coin.

Although not shown in FIGS. 1–3, the hopper 15 is provided with a coin sensor (77, in FIG. 4) to determine presence or absence of the coin in the hopper. An example usable for such purpose is one disclosed in Japanese Utility Model Application No. 49947/1983.

Figure 4:
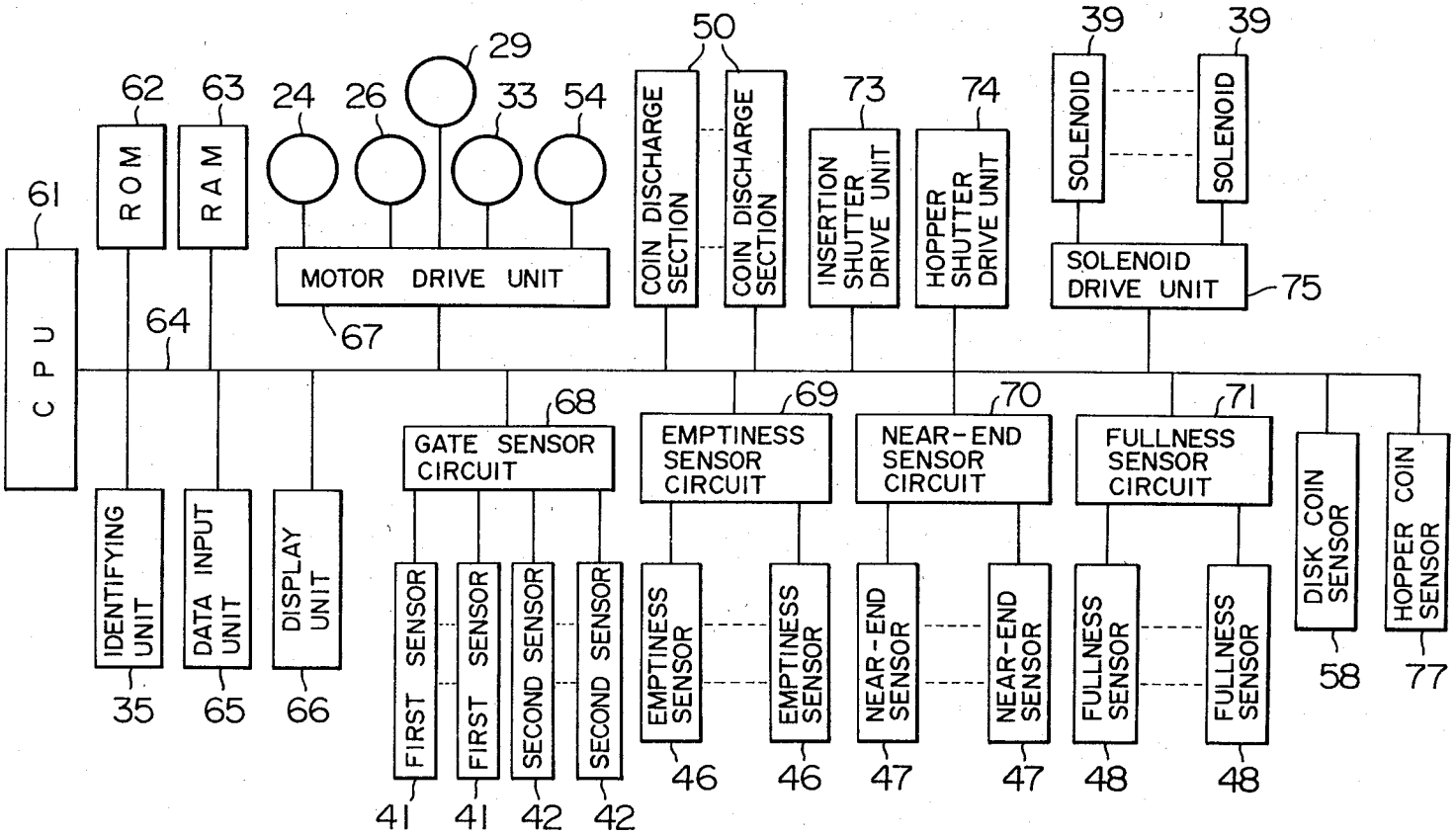
FIG. 4 is a block diagram showing the control arrangement incorporated in the coin processing apparatus of FIG. 1.
Figure 5A:
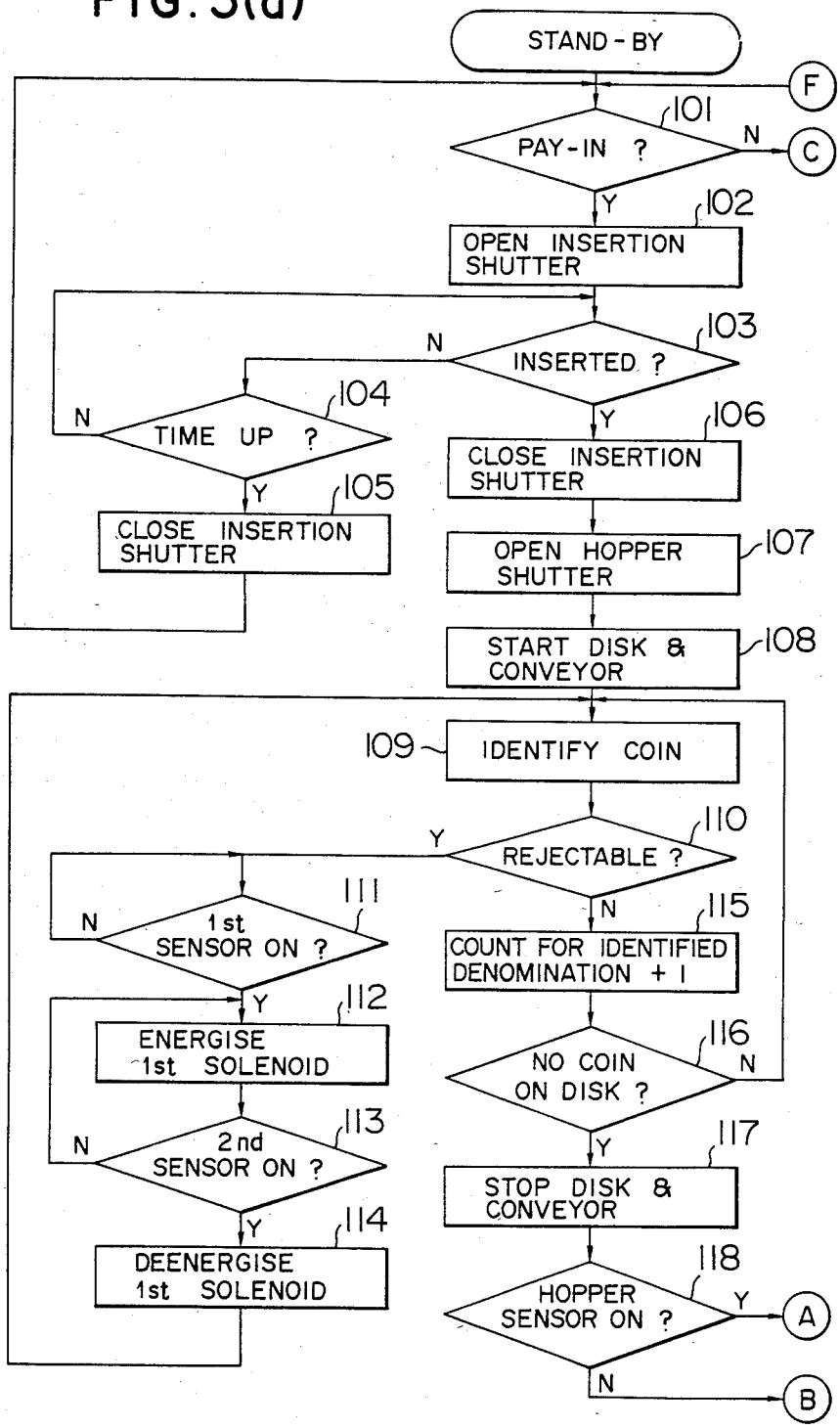
FIGS. 5(*a*)–5(*d*) are flow charts showing operation of the coin processing apparatus of FIG. 1.
Figure 5B:
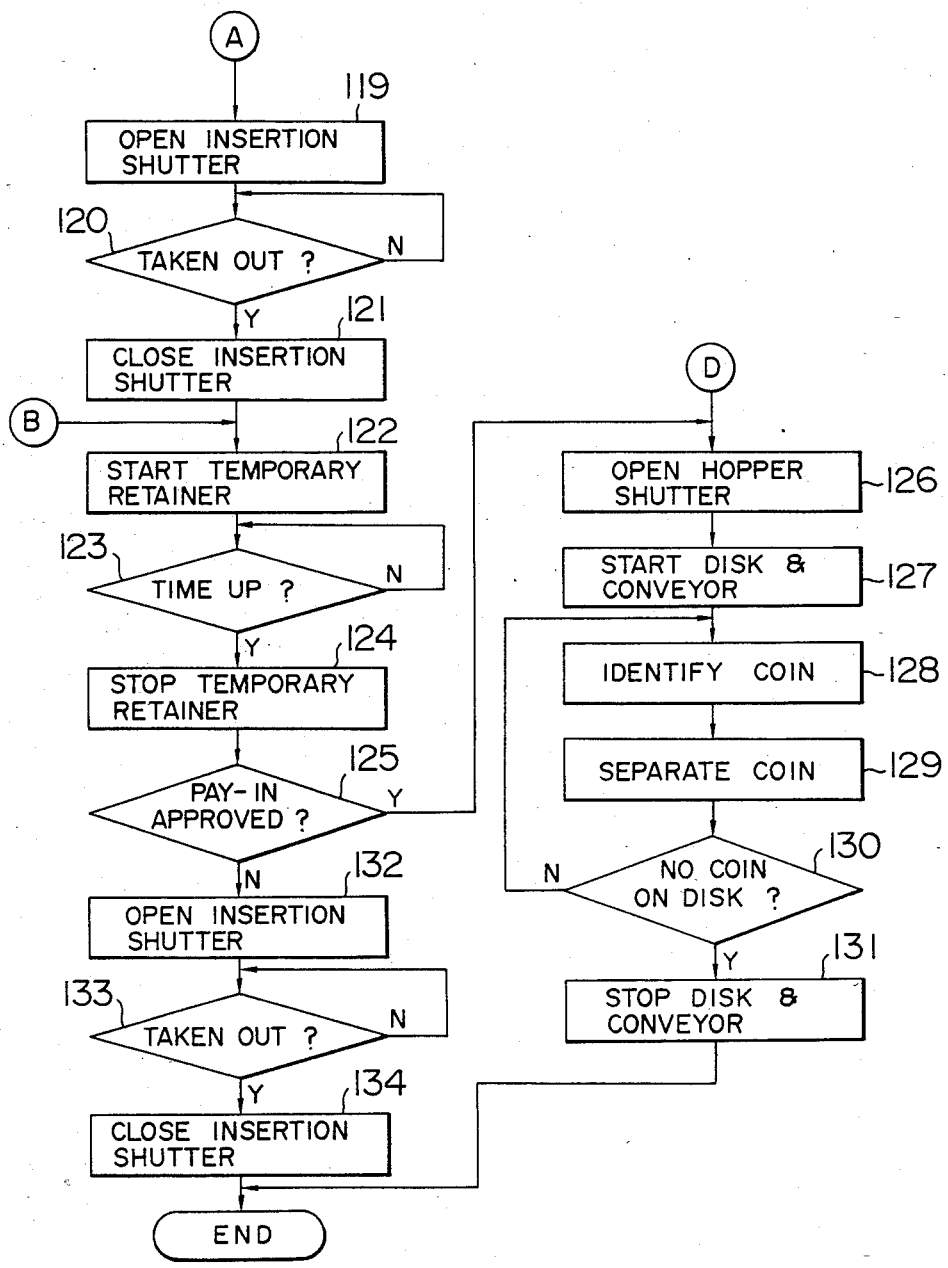
Figure 5C:
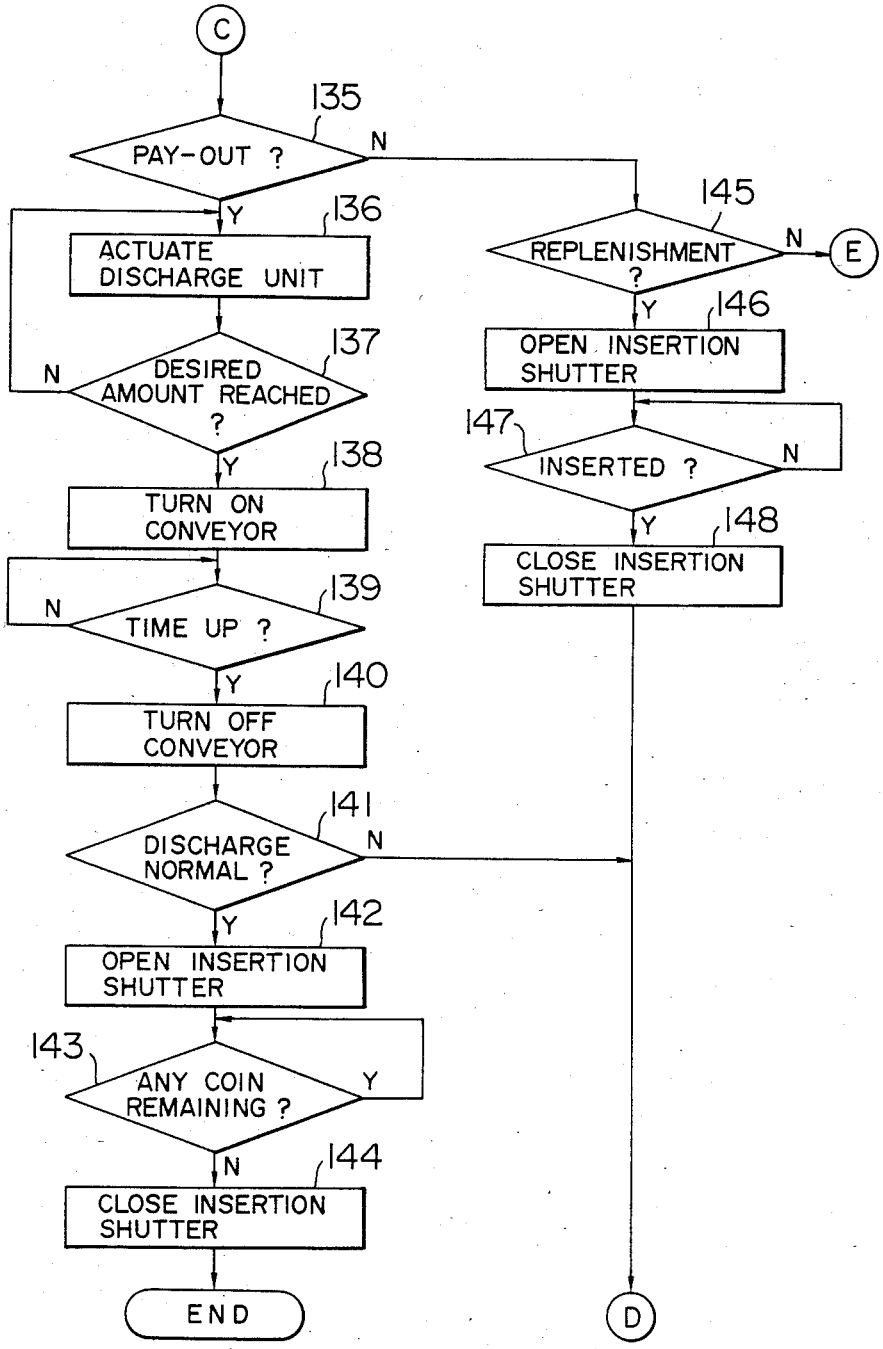
Figure 5D:
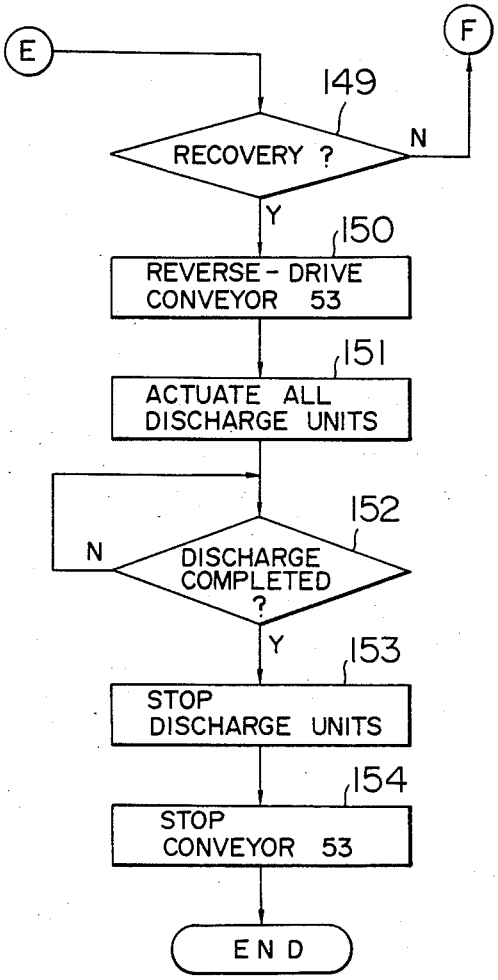

FIG. 4 shows a control section. A central processing unit (hereinafter referred to as a CPU) 61 operates in accordance with programs stored in a read-only memory (hereinafter referred to as ROM) 62 to control pay-in and pay-out of coins. A random access memory (hereinafter referred to as RAM) 63 stores various data relating to coin processing, such as the numbers and the total monetary values of the respective denominations of the coins paid in and of the coins paid out, respectively, and the total monetary value and the numbers of the respective denominations of the coins pay-out of which has been demanded by means of a data input unit, to be described later.

The identifying unit 35 is connected via a bus 64 to the CPU 61 and the result of identification is supplied to the CPU 61.

The data input unit 65 is provided on the customer receiving surface 12 of the casing 11. It may alternatively be provided on a separate console unit or terminal. Although not illustrated as such, the data input unit 65 includes the keys, switches and the like as described below.

Denomination keys: used for inputting the denomination of the coins to be paid out.

A ten-key: used for inputting data concerning the number and the monetary value.

A mode selection switch: so formed that only the staff of the bank can operate, and operated to select one of a replenishment mode, a pay-in/pay-out mode, and a recovery mode. In the replenishment mode, coins are fed to the coin container section in preparation for pay-in/pay-out mode. In the pay-in/pay-out mode, the apparatus can be operated for pay-in (deposition of coins into the apparatus) or pay-out (withdrawal or dispensing of coins from the apparatus). In the recovery mode, all the coins in the coin container section 44 are recovered in the recovery box 55.

A pay-in key and a pay-out key: operated for paying coins into or out of the apparatus.

An accept key: operated when the operator (a customer or a member of the staff of the bank) approves the displayed data indicating the numbers or monetary values obtained by counting the coins or calculation, to issue an accept command.

A return key: operated when the operator does not approve the displayed data, to issue a return command.

A cancel key: operated during a pay-out mode for returning the coins to the original coin container section.

A display unit 66 is provided on the customer receiving surface 12 or the like and is capable of displaying data from the CPU61 and the numbers and the amounts (monetary values) of the respective denominations and the total amount (monetary value).

A motor drive unit 67 is responsive to the commands from the CPU61 for controlling and driving the electric motors 24, 26, 29, 33, and 54.

A gate sensor circuit 68 receives the detection outputs of the first sensors 41 and the second sensors 42 (in total 16 such sensors are provided).

An emptiness sensor circuit 69, a near-end sensor circuit 70 and a fullness sensor circuit 71 receive the detection outputs respectively from the emptiness sensors 46, the near-end sensors 47 and the fullness sensors 48 and transfer the thus-received detection outputs to the CPU 61.

The coin discharging section 50 for each coin container cylinder 45 is driven in accordance with the command from the CPU61 to discharge the coins from the corresponding coin container cylinder 45.

An insertion shutter drive unit 73 and a hopper shutter drive unit 74 are responsive to the commands from the CPU 61 for opening and closing the insertion shutter 16 and the hopper shutter 17.

A solenoid drive unit 75 is responsive to the commands from the CPU 61 for selectively energizing the solenoids 39 to deflect or separate the coin at the desired separating section.

The coin sensor 58 shown in FIG. 2 and provided over the disk and the coin sensor 77 not shown in FIG. 2 but described previously as being provided in the hopper 15 have their detection outputs inputted to the CPU61.

Operation of the coin processing apparatus is described with reference to the flow charts of FIG. 5.

PAY-IN MODE

Pay-in can be made when the mode selection switch is in the pay-in/pay-out mode. When the pay-in key is pressed, the CPU61 judges that the pay-in mode has been selected (step 101), and opens the insertion shutter 16 (102). The CPU61 waits until a coin or coins are inserted in the hopper 15 (103, 104). The detection of insertion (103) is made by referring to the information from the coin sensor 77. When no coin is inserted before a predetermined time period expires (104), the insertion shutter is closed (105), and the procedure returns to the step 101.

If the insertion is detected before the expiration of the predetermined time period (103, 104), the insertion shutter 16 is closed (106) a fixed time interval (e.g., 3 seconds) after the detection of the insertion, and then the hopper shutter 17 is opened (107), so that the coins are dropped from the hopper 15 onto the disk 20. The motors 24, 26, 29 and 54 are then started to drive the conveyor sections 19, 28 and 53 (108). The disk 20 therefore rotates causing the coins to align along the periphery by centrifugal force and successively sending the coins out one after another. The coins sent out of the disk 20 are conveyed by the conveyor belt 22 of the path 21 along the length of the conveyor belt 22.

When each coin passes the identifying unit 35 identification of the coin is made as to its denomination (or whether it is abnormal). If the coin is found to be abnormal (110), the coin is guided into the reject return section 56. This rejection is accomplished by energizing (112) the solenoid 39 corresponding to the leftmost (in FIG. 1) separating section 36 to cause the branching plate 37 to project in the path 21 when the first sensor 41 of the first separating section 36 detects the coin. When the second sensor 42 detects entry of the coin into the reject return section 56 (113), the first solenoid 39 is deenergized (114) so that the branching plate is withdrawn from the path 21. The rejected abnormal coin is dropped through the reject return section 56 onto the conveyor belt 53*a* and is returned through the conveyor belt 53*a* to the hopper 15. The hopper shutter 17 is already closed so that the abnormal coin is retained in the hopper 15.

If the coin is normal, a signal indicative of the denomination is produced and accordingly 1 is added to the content of the count area for the corresponding denomination provided in the RAM64 (115). These procedures are repeated for each coin until it is judged that there is no longer any coin on the disk 20 (116). Thus, the numbers of the coins of the respective denominations can be counted. The result of the count is displayed on the display unit 66. Since the separating sections 36 other than that for the abnormal coins are not activated, all the normal coins passed through the path 21 are carried by the auxiliary conveyor section 28 and are then successively transferred to the bucket of the conveyor belt 32 of the temporary retainer section 31.

When identification and transfer to the temporary retainer section 31 of all the coins are completed (116), the motors 24, 26 and 29 are stopped to stop the conveyor sections 19, 28 and 53 (117).

Then, judgement is made as to whether there are any rejected abnormal coins (118). This is accomplished by referring to the coin sensor 77 in the hopper 15 since any rejected abnormal coins are in the hopper 15. When it is found that there are, the insertion shutter 16 is opened (119) and is closed (121) after the abnormal coins are taken out by the operator (120).

After that, or after the step 118 where it is found that there is no rejected abnormal coin, the motor 33 is started to drive the temporary retainer 31 (122). As a result, the coins in the temporary retainer 37 are all transferred into the hopper 15. The motor 33 is stopped upon expiration of a time interval (e.g., 5 seconds) required for the transfer (123, 124).

The display of the numbers of the respective denominations and the like on the display unit 66 allows the operator to examine the displayed data. When the operator judges that the displayed data is agreeable and the coins may be accepted, he presses the accept key in the data input unit 65 to give the accept command (125). Responsive to the accept command, the CPU61, also serving as an accept controller, causes the hopper shutter 17 to be opened again (126) thereby transferring the coins onto the disk 20. Then the motors 24 and 26 are started (127) to drive the conveyor section 19. As a result, the coins are again successively sent out of the disk 20 onto the path 21 and are conveyed by the path 21. Identification is again made by the identifying unit 35 as to the denomination (128), and the separating section 36 corresponding to the identified denomination is actuated (129) to deflect the coin at the appropriate separating section and thereby lead it to the appropriate container cylinder 45. The separation and the leading of each coin, i.e., sorting, is repeated until it is judged there is no more coin on the disk 20 (130). When all the coins have been sorted, the motors 24 and 26 are stopped to stop the conveyor section 19 (131).

When, at the step 125, the operator presses the return key in the data input unit 65, because the operator does not agree with the displayed data or because of any other reason, the insertion shutter 16 is opened (132) to allow the operator to take out the coins. After it is detected that the coins have been taken out (133), the insertion shutter 16 is closed and the procedure is terminated.

PAY-OUT MODE

Pay-out can be made when the mode selection switch is in pay-in/pay-out mode. When the pay-out key is pressed, and the amount (monetary value) and/or the number of each denomination is inputted by means of the denomination key and/or the ten-key (131), the CPU61 judges that a pay-out command has been given. The CPU61 then causes actuation of the discharging device or devices 50 for the respective coin container cylinder or cylinders 45 containing the denominations whose pay-out is commanded by operation of the data input unit 65. The discharging operation is repeated until it is found that the number of the coins of each denomination coincides with the desired number indicated by the inputted pay-out data (137). For this purpose, the coins discharged are counted (each time discharge of a coin is detected, 1 is added to the count value of the corresponding denomination) and the count value is compared with the pay-out data. The discharged coins are received on the conveyor belt 53*a* of the pay-out conveyor section 53.

When the desired numbers of coins are discharged as described above, the motor 54 is forward-rotated to drive the pay-out conveyor section 53, so that the coins on the conveyor belt 53*a* are transferred into the hopper 15. The rotation of the motor 54 is continued for a predetermined time interval (e.g., 15 seconds) sufficient to transfer the coins to the hopper 15, after which the motor is stopped (139, 140).

Then, it is judged whether the discharging operation and the transfer operation have been completed without any abnormality (141). More particularly it is judged whether detecting devices, not shown, provided to detect a fault during discharge have detected a fault, or whether the cancel key in the data input unit 65 has been pressed. When it is found that there has been an abnormality, the procedure goes to the step 126, where the hopper shutter 17 is opened and the coins are dropped from the hopper 15 onto the disk 20, and are then returned to the respective container cylinders 45 (127–131) and the procedure is terminated.

When the discharge is found normal (and the cancel key has not been pressed), the insertion shutter 16 is opened (142) to allow the operator to take out the coins. After it is detected that all the coins have been taken out (143), the insertion shutter 16 is closed and the procedure is terminated.

REPLENISHMENT MODE

To replenish coins in the container cylinders 45, the mode selection switch is positioned at the replenishment mode. When the CPU61 detects that the replenishment mode is selected (145), the insertion shutter 16 is opened (146). When coins for replenishment are inserted in the hopper 15, this is detected by the CPU61 (147). After that the hopper shutter 17 is opened (126) to drop the coins onto the disk 20, and the coins are then delivered to the respective container cylinders 45 (127–138), and the procedure is terminated.

RECOVERY MODE

To recover the coins from the container cylinders to the recovery box 55, the mode selection switch is positioned at the recovery mode. When the CPU61 detects that the recovery mode is selected (149), the motor 54 is reverse-rotated (150). Thereafter, all the discharging devices 50 are started to discharge coins from all the container cylinders 45. The discharging operation of each discharging device 50 is continued until the emptiness sensor 46 detects that all the coins have been discharged (152). The coins discharged from the container cylinders are transferred by the reverse-moving conveyor belt 53*a* into the recovery box 55. When the discharging operation is completed the discharge unit 50 is stopped (153). After all the discharging devices have been stopped and when a time interval (e.g., about 10 seconds) set at a value necessary for the coin discharged from the leftmost (in FIG. 1) container cylinder to reach the recovery box 55 has expired, the motor 54 is stopped (154) and the procedure for the recovery is terminated.

Modifications of the separating section 36 will now be described.

Figure 6:
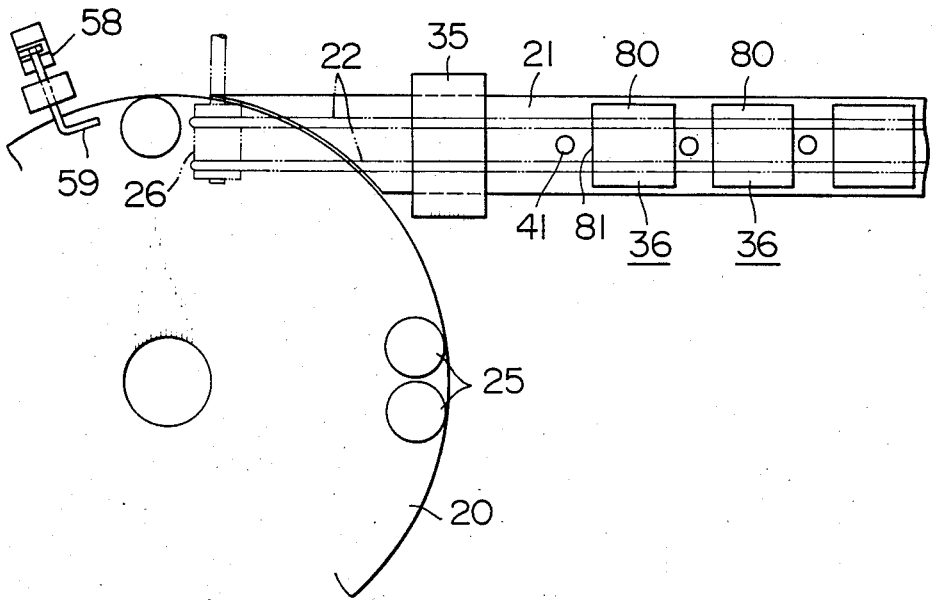
FIG. 6 is a plan view showing another example of separating sections.
Figure 7:
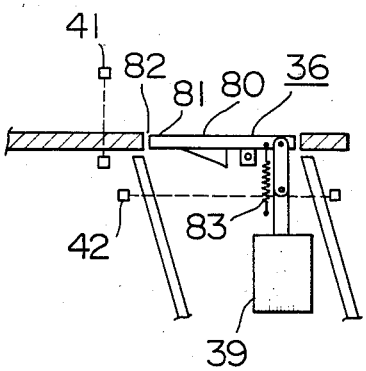
FIG. 7 is a sectional view showing one of the separating sections of FIG. 6.

FIGS. 6 and 7 show another example of separating section 36.

The separating section of this example is provided with a branching plate 80 which is buried so as to be normally flush with the surface of the path 21. When a coin to be deflected is detected by the first sensor 41, a solenoid 39 is energized so that that end 81 (the left end in FIGS. 6 and 7) of the branching plate 80 through which the coins are entered into the separating section is raised above the surface of the path 21 to form an opening (separating opening) 82, through which the coin is guided to its destination (container cylinder or the reject return section). When the passage of the coin through the separating opening, is detected by a second sensor 42, the solenoid 39 is deenergized and the branching plate 80 is returned by a push-up spring (in the form of a compression spring) 83 to the original position. When it is desired that the separating section should allow the coin to pass, the solenoid 39 is kept deenergized.

The coin processing apparatus according to the present invention may additionally be provided with an arrangement for placing a space between successive coins as they are conveyed along the path. An example of such arrangement is shown in FIG. 8.

Figure 8:
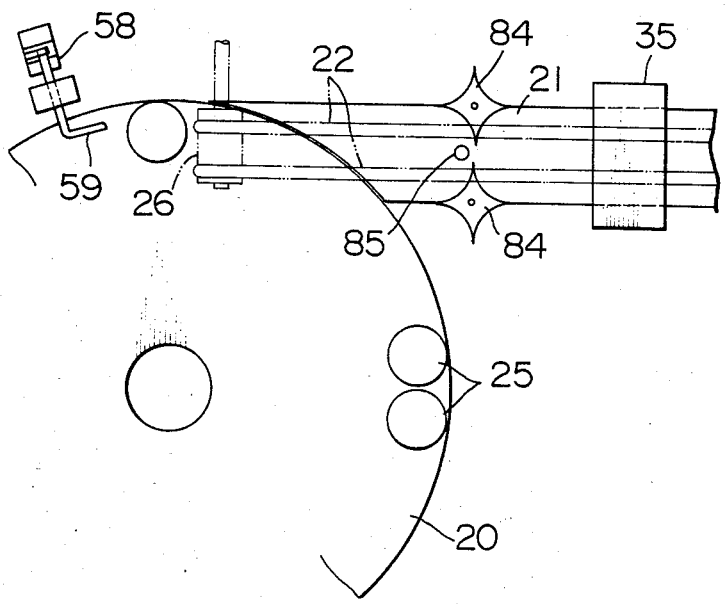
FIG. 8 is a plan view showing an example of arrangement for placing a space between successive coins.

As illustrated in FIG. 8, a pair of star-shaped wheels 84, 84 are provided on the opposite sides of the path 21 and on the upstream of the identifying unit 35. When a coin approaches the pair of star-shaped wheels 84, 84, it is detected by a sensor 85, upon which a pulse motor, not shown, is driven to rotate the star-shaped wheels 84, 84 by 90°. By such action of the star-shaped wheels 84, 84, a space is introduced between the successive coins (even when the coins are fed to the star-shaped wheels 84, 84 without any space between successive coins), and possibility of errors in the identification by the identifying unit 35 and in the separation by the separating sections 36 is reduced.

The star-shaped wheels 84, 84 may alternatively be provided between the identifying unit 35 and the separating sections 36. In this case, it is ensured that a space is present between successive coins before their entry into the separating sections.

Figure 9:
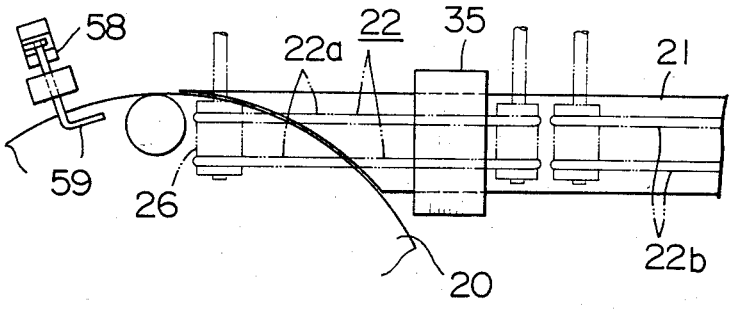
FIG. 9 is a plan view showing another example of arrangement for placing a space between successive coins.

Another arrangement for placing a space between successive coins is shown in FIG. 9. As illustrated, two conveyor belts 22*a* and 22*b* are provided instead of one 22 (FIG. 1) and are junctioned at a location on the downstream side of the identifying unit 35. The conveyor belt 22*b* of the downstream side is driven at a higher speed than the conveyor belt 22*a* of the upstream side, so that the spacing between the successive coins is enlarged at the junction. The junction may alternatively be positioned on the upstream side of the identifying unit 35.

In the embodiment described, abnormal coins are separated at one of the separating sections and returned to the hopper 15 while normal coins are transferred to and retained in a temporary retainer section 31 upon first pass of the coins through the identifying unit 35 in the pay-in mode. But the arrangement may alternatively be such that, upon the first pass, all the coins are transferred to and retained in the temporary retainer section 31.

It is possible to convey the coins at a higher speed when the coins are identified for the first time (i.e., after having been inserted) and no separation is conducted. By adopting the higher speed, the time necessary until the coins are all transferred to the temporary retainer section is reduced with the result that the overall time for processing the coins can be reduced.

As has been described, according to the present invention, coins inserted in a lump, i.e., collectively can be automatically and quickly processed and deposited in the apparatus, while data processing for the pay-in is simultaneously conducted. The inserted coins are counted and retained in a temporary retainer section pending approval by the operator who is thus given an opportunity to examine the displayed data indicative of the result of the counting. When the operator does not approve, all the coins can be returned. Thus, errors in pay-in operation and any other troubles can be avoided. Thus the operator who is usually a customer will feel comfortable in using the apparatus, and efficient utility of coins is enabled.

Moreover, the conveyor path is used for the transfer of the coins to the temporary retainer section (the first pass) and the transfer of the coins to the container section (the second pass), so that it is not necessary to provide two separate conveyor paths and to switch between the two paths. The temporary retainer section can be of a simple construction. During the first pass, the conveying speed may be higher, so that the overall processing time can be reduced.

What is claimed is:

1. A coin processing apparatus comprising:

coin receiving means for receiving coins in a lump;

conveyor means including a conveyor path, receiving the coins from the coin receiving means and conveying the coins successively;

identifying means for identifying each coin as to denomination as the coin is conveyed by the conveyor means;

temporary retainer means receiving the coins from the conveyor means and transferring the coins to the coin receiving means;

separating devices provided to separate, when actuated, the coin from the conveyor path;

container devices associated with the respective separating devices to receive and contain the coins separated by the associated separating device; and control means causing, when coins are inserted in the coin receiving means, the coin receiving means and the conveyor means to be actuated such that the coins be transferred from the coin receiving means, through the conveyor means to the temporary retainer means and causing the identifying means to identify the coins successively conveyed by the conveyor means, and to produce data concerning the coins identified, said control means causing, after all the coins inserted have been transferred out of the coin receiving means, the temporary retainer means to be actuated such that the coins be transferred from the temporary retainer means to the coin receiving means, the control means being responsive to an accept command inputted by an operator for actuating the coin receiving means and the conveyor means such that the coins having been transferred from the temporary retainer means to the coin receiving means be transferred to the conveyor means, and causing the identifying means to identify the coins as to denomination, and causing the separating devices to selectively separate the coins in accordance with the result of the identification.

2. An apparatus according to claim 1, further comprising coin discharging devices associated with the respective coin container devices, each discharging device discharging coins of the number required by pay-out data inputted by an operator from the associated coin container device, and pay-out conveyor means for conveying the discharged coins to the coin receiving means, whereby the coins placed in the coin receiving means are served as pay-out coins.

3. An apparatus according to claim 1, further comprising display means, wherein said control means causes display of the result of the identification made when the coins having been inserted are passed through the identifying means and transferred to the temporary retainer means, thereby enabling the operator to examine the displayed data before deciding whether or not to issue the accept command.

4. An apparatus according to claim 1, further comprising an additional separating device for separating coins which have been recognized as abnormal by the identifying means, from the conveyor path, and means for conveying the abnormal coins separated by said additional separating device to the coin receiving means.

5. An apparatus according to claim 1, wherein the temporary retainer means comprises a conveyor provided with a bucket which is normally at a rest position to receive the coins transferred by the conveyor means by the bucket, and which, when actuated, moves to discharge the coins from the bucket such that the coins are transferred to the coin receiving means.

6. An apparatus according to claim 1, wherein said conveyor means further comprises a rotatable disk device receiving coins in a lump from the coin receiving means and sending coins out successively to the conveyor path.

7. An apparatus according to claim 1, further comprising means for placing a space between successive coins before the coins are passed through the separating devices.

8. An apparatus according to claim 7, wherein said means for placing a space is provided to place a space between coins before the coins are passed through the identifying means.

* * * * *